United States Patent [19]

Lubsen et al.

[11] 4,382,552

[45] May 10, 1983

[54] LIQUID APPLICATOR

[75] Inventors: Timothy A. Lubsen, Worthington; James D. Amerine, Marysville, both of Ohio

[73] Assignee: The O. M. Scott & Sons Company, Marysville, Ohio

[21] Appl. No.: 299,825

[22] Filed: Sep. 8, 1981

[51] Int. Cl.[3] ..... B05B 7/30

[52] U.S. Cl. ..... 239/317; 239/318

[58] Field of Search ..... 239/304, 310, 365, 317, 239/318

[56] References Cited

U.S. PATENT DOCUMENTS

| | | | |
|---|---|---|---|
| 2,006,437 | 7/1935 | Burgess et al. | 299/88 |
| 2,050,522 | 8/1936 | Evans et al. | 239/318 X |
| 2,760,820 | 8/1956 | Cirese | 299/83 |
| 2,951,645 | 9/1960 | Price et al. | 239/318 |
| 3,104,823 | 9/1963 | Hayes | 239/304 |
| 3,181,797 | 5/1965 | Hayes | 239/317 |
| 3,467,314 | 9/1969 | Grubb | 239/138 |
| 3,632,046 | 1/1972 | Hengesbach | 239/318 |

*Primary Examiner*—John J. Love
*Assistant Examiner*—Mary McCarthy
*Attorney, Agent, or Firm*—James B. Raden; Harold J. Holt

[57] ABSTRACT

A liquid applicator for dispensing a chemical in dilute aqueous form. The applicator comprises a conduit adapted at one end for connection with a water source and at another end for the discharge of a chemical in dilute aqueous form. Two containers are connected with the conduit one adapted to contain a concentrated liquid chemical, the other adapted to contain the chemical premixed with water. The containers are connected with the conduit in series with a two stage aspirator so that concentrated chemical from the first container is mixed with water and passed into the second container and the mixture is then further diluted and discharged from the applicator.

6 Claims, 2 Drawing Figures

LIQUID APPLICATOR

Figure 1:
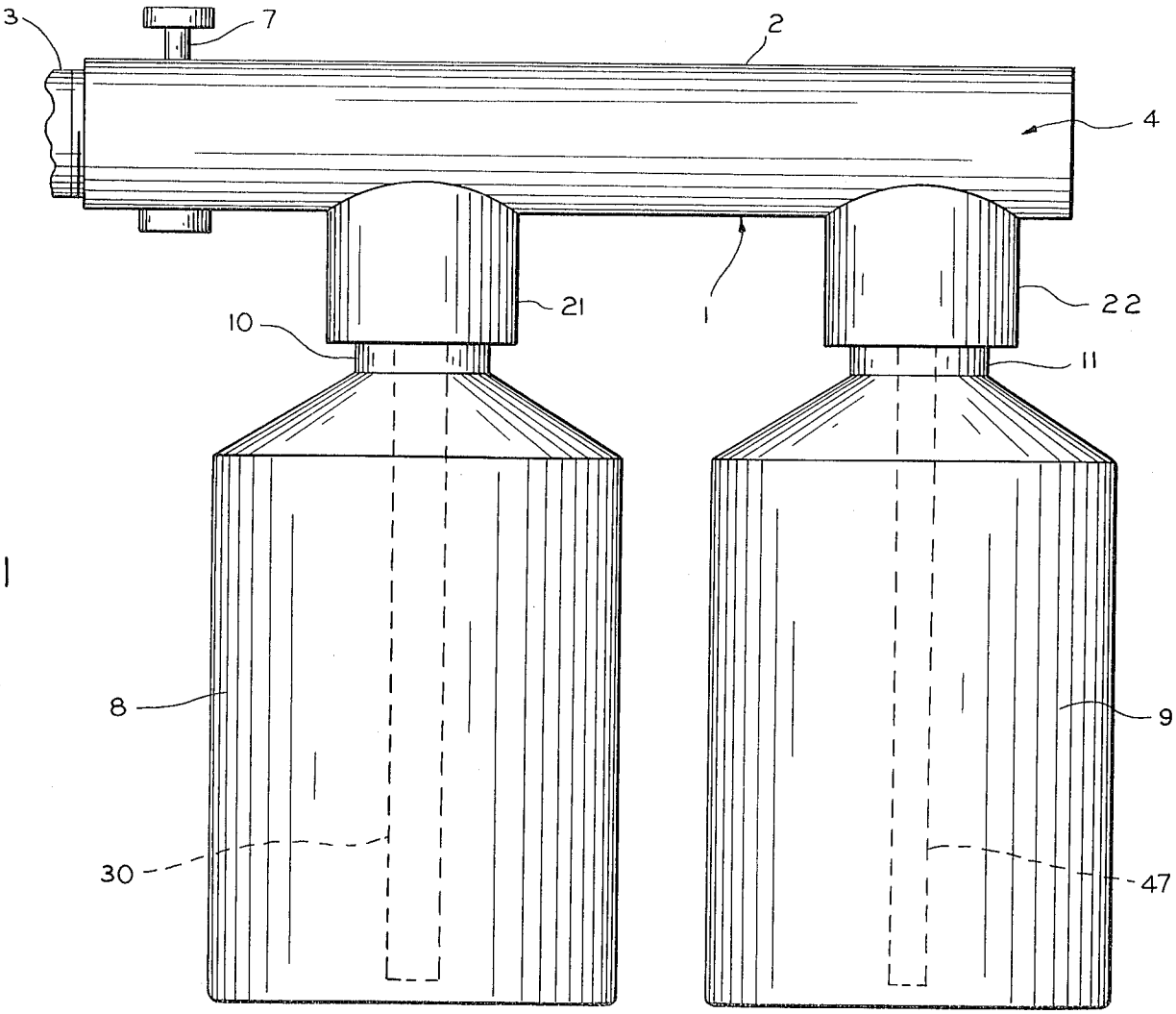

This invention relates to a liquid applicator for dispensing a chemical in dilute aqueous form and to a container for concentrated chemical for use with the applicator.

Typical hose end sprayers, of the type used for applying lawn or garden chemicals, operate well at fixed, low dilution ratios. However, they tend to become very inaccurate at high dilution ratios. For example, a sprayer unit may work well at 24:1 dilution ratio but very poorly at ratios of 100:1 and higher. Accordingly, to use concentrates which must be diluted to high ratios, it is normally necessary to pre-dilute the concentrate with water. Thus, to use a concentrate at a 240:1 ratio, it would be pre-diluted to 10:1 and then used with a sprayer which has a 24:1 dilution ratio. The disadvantage of such pre-dilution is that the user must pour, mix or otherwise handle highly concentrated chemicals.

It is accordingly a major object of the present invention to provide a liquid applicator for dispensing a chemical in dilute aqueous form which provides accurate high dilution ratios without premixing by the operator.

The foregoing and other objects of the invention are achieved in a liquid applicator containing a two stage aspirator which performs two separate dilutions within the applicator. The first stage aspirator draws a concentrated chemical from a first container, dilutes it with water and deposits the mixture in a second premix container. The second stage aspirator draws premix from the second container and further dilutes it as it is being sprayed or otherwise discharged from the applicator. Total dilution is the product of the two dilutions. Dilution ratio, as expressed herein, is the ratio of total mix to chemical.

Specifically, the invention involves a liquid applicator for dispensing a chemical in dilute aqueous form comprising in combination conduit means adapted at a first end thereof for connection with a source of water under pressure and at a second end thereof for the discharge of said water containing a chemical in dilute aqueous form therein, said conduit means comprising at least two aqueous passageways, control means at the water source end of said conduit for controlling the flow of water to said aqueous passageways, at least two containers connected with said conduit means, the first container adapted to contain a concentrated liquid chemical therein, the second container adapted to contain chemical premixed with water, the first passageway of said conduit means leading from said water source to said second container and containing a first stage aspirator therein for withdrawal of liquid from said chemical container, the second passageway leading from said water source to the discharge end of said conduit and containing a second stage aspirator therein for withdrawal of liquid from said chemical container, the passageways thereby connecting said containers in series so that concentrated chemical from said first container is premixed with water and passed into said second container and the premix is thereafter further diluted with water and discharged from the applicator.

Figure 2:
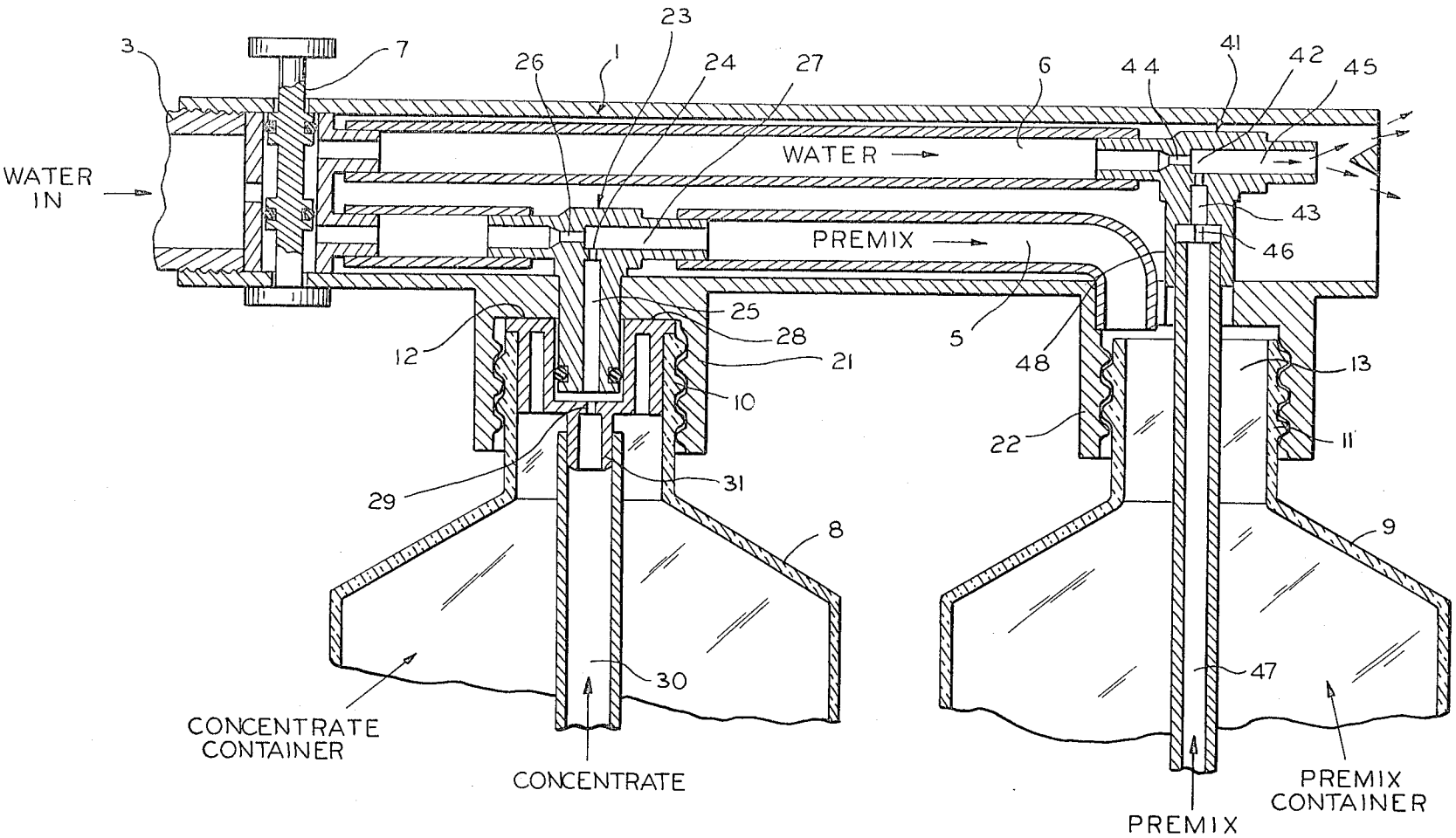

The invention will be better understood by reference to the accompanying drawing in which:

FIG. 1 is an elevational view of an applicator in accordance with the invention; and FIG. 2 is an enlarged longitudinal cross-sectional view of the applicator shown in FIG. 1.

As shown in the drawing, the applicator comprises a conduit generally shown at 1. The conduit has a cylindrical housing 2 and is adapted at one end thereof for connection with a water source under pressure by means of a coupling 3. The opposite end of the conduit acts as a nozzle for discharge of an aqueous liquid in the form of a spray past a conical deflector 4. The conduit has two aqueous passageways 5 and 6 and a spool valve 7 at the water source end of the conduit to control the flow of water to one or the other of said aqueous passageways. It will be apparent from FIG. 2 that valve 7 is shown in position to guide the flow of water from the water source to passageway 6. If valve 7 is shifted to the opposite side of the conduit (depressed downwardly), the flow of water will be shunted to passageway 5.

Two containers 8 and 9 are connected to conduit 1. Container 8 is adapted to contain a concentrated liquid chemical, as for example, a lawn fertilizer or pesticide. Container 9 is adapted to contain the chemical premixed with water. Containers 8 and 9 are attached to the conduit by externally threaded neck portions 10 and 11, respectively, adjacent to their respective container openings 12 and 13. The threaded neck portions are coupled to internally threaded sockets 21 and 22 respectively, in conduit 1.

Passageway 5 leads from the water source end of conduit 1 across container 8 to premix container 9 and contains a first stage aspirator, generally designated by the numeral 23, at an intermediate position along its length. Aspirator 23 comprises a horizontally disposed venturi 24 in passageway 5 communicating with a vertically disposed liquid flow channel 25. Venturi 24 consists of a high velocity passageway portion 26 and a passageway portion 27 of reduced velocity and larger diameter.

Container 8 contains a plug 28 frictionally engaged within the neck portion 10 to restrict passage of chemical from the container. Within a central portion of plug 28 is an orifice 29 for metering the withdrawal of chemical from the container. When an area of low pressure is created at the head of channel 25 by passage of water through venturi 24, chemical concentrate is withdrawn from container 8 through a tube 30 extending to the bottom of the container from a flange 31 depending from plug 28. The concentrate flows through tube 30, orifice 29 and channel 25 to passageway 5. The diameter of the metering orifice 28 determines the amount of concentrate withdrawn from the container and thus the ratio of water mixed with chemical concentrate in passageway 5.

Passageway 6 leads from the water source end of conduit 1 across container 9 to the discharge end of the conduit and contains a second stage aspirator, generally designated by the numeral 41, near the discharge end of the conduit. Aspirator 41 comprises a venturi 42 in passageway 6 communicating with a liquid flow channel 43. The venturi again consists of a high velocity portion 44 and a reduced velocity portion 45 of wider diameter. At the bottom of channel 43 is a metering orifice 46. A tube 47 extends from within a flange 48 depending from passageway 6 to the bottom of container 9. Thus, the second stage aspirator 41 withdraws premixed chemical from container 9 through tube 47, orifice 46 and channel 43.

It will be seen that metering orifice 46 is a component of conduit 1 whereas metering orifice 29, in the first stage, is a component of container 8. The second stage dilution ratio is accordingly fixed in the applicator device whereas the first stage dilution ratio may be varied with the orifice size in the concentrate container. Thus, the ultimate degree of dilution may be determined by the size of the metering orifice in the chemical concentrate container.

Container 8 may therefore be equipped with a metering orifice whose size is appropriately selected for the degree of dilution desired for the chemical concentrate stored in the container. The bottle may be equipped, when not in use, with a suitable closure (not shown) as, for example, an internally threaded cap.

In operation, the applicator of the invention is connected to a garden hose or other water source through coupling 3. If desired, a nozzle or other on-off water valve (not shown) may be inserted between the hose and the applicator. Valve 7 is then depressed so that water flows through passageway 5 across the first stage aspirator 23, mixes with and partially dilutes concentrated chemical from container 8 and fills container 9 with a premix. When container 9 is full, valve 7 is pressed upward to shunt the flow of water to passageway 6 where it flows across the second stage aspirator 41, further dilutes the premixed fluid from container 9 and discharges the finally diluted aqueous mixture as a spray past conically shaped deflector 4 at the exit end of the applicator. When the premixed fluid in container 9 is exhausted, additional premix is generated by appropriate adjustment of valve 7. Upon completion of spraying container 8 is disconnected and any remaining concentrate may be stored by capping the container. Neither upon reuse of the same concentrate nor upon change of concentrate, is it necessary for the user to make adjustments of any kind to obtain the proper degree of dilution. The chemical concentrate in container 8 always remains at the same level of concentration. Moreover, because dilution at both the first and second stage is within the normal limits of accurate dilution ratios for conventional aspirator units, it is possible to combine both accuracy and a high level of dilution in a single device.

We claim:

1. A liquid applicator for dispensing a chemical in dilute aqueous form comprising in combination conduit means adapted at one end thereof for connection with a source of water under pressure and at another end thereof for the discharge of said water containing a chemical in dilute aqueous form therein, said conduit means comprising at least two aqueous passageways, control means at the water source end of said conduit for controlling the flow of water to said aqueous passageways, at least two containers connected with said conduit means, the first container adapted to contain a concentrated liquid chemical therein, the second container adapted to contain the chemical premixed with water, the first passageway of said conduit means leading from said water source to said second container and containing a first stage aspirator therein for withdrawal of liquid from said chemical container, the second passageway leading from said water source to the discharge end of said conduit and containing a second stage aspirator therein for withdrawal of liquid from said premix container, the passageways thereby connecting said containers in series so that concentrated chemical from said first container is premixed with water and passed into said second container and the premix is thereafter further diluted with water and discharged from the applicator.

2. The applicator of claim 1 in which each of said aspirators comprised a venturi in each of said passageways, said venturi communicating with each of said containers for withdrawal of liquid therefrom through a liquid flow channel containing a metering orifice therein.

3. The applicator of claim 2 in which the metering orifice for said first stage aspirator is a component of said chemical container.

4. The applicator of claim 3 in which the chemical container comprises an opening at an upper end thereof, a neck portion adjacent the opening adapted for connection to the liquid applicator and a plug within the neck portion to restrict passage of chemical from the chemical container, said metering orifice being located in said plug.

5. The applicator of claim 2 in which the metering orifice for said second stage aspirator is a component of said conduit means.

6. The applicator of claim 1 in which the control means is a valve, the valve acting to guide the flow of water from the water source to one or the other of said aqueous passageways.

* * * * *